US008316996B2

(12) United States Patent
Hashimoto et al.

(10) Patent No.: US 8,316,996 B2
(45) Date of Patent: Nov. 27, 2012

(54) ELEVATOR APPARATUS HAVING RESCUE OPERATION CONTROLLER

(75) Inventors: Jun Hashimoto, Tokyo (JP); Takaharu Ueda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 448 days.

(21) Appl. No.: 12/664,670

(22) PCT Filed: Jul. 25, 2007

(86) PCT No.: PCT/JP2007/064581

§ 371 (c)(1),
(2), (4) Date: Dec. 15, 2009

(87) PCT Pub. No.: WO2009/013821

PCT Pub. Date: Jan. 29, 2009

(65) Prior Publication Data

US 2010/0170751 A1 Jul. 8, 2010

(51) Int. Cl.
*B66B 1/32* (2006.01)

(52) U.S. Cl. ..... 187/288; 187/281; 187/393

(58) Field of Classification Search ..... 187/247, 187/248, 277, 281, 286, 287, 288, 289, 290, 187/293, 296, 297, 298, 305, 306, 314, 391–393
See application file for complete search history.

(56) References Cited

U.S. PATENT DOCUMENTS

| | | | | |
|---|---|---|---|---|
| 4,220,222 | A | 9/1980 | Kamaike et al. | |
| 6,196,355 | B1 * | 3/2001 | Fargo et al. | 187/393 |
| 6,264,005 | B1 * | 7/2001 | Kang et al. | 187/290 |
| 6,269,910 | B1 * | 8/2001 | Fargo et al. | 187/287 |
| 6,311,801 | B1 * | 11/2001 | Takagi et al. | 187/290 |
| 6,557,670 | B2 * | 5/2003 | Wang | 187/290 |
| 6,827,182 | B2 * | 12/2004 | Araki | 187/290 |
| 7,434,664 | B2 * | 10/2008 | Helstrom | 187/314 |
| 7,549,515 | B2 * | 6/2009 | Tegtmeier et al. | 187/288 |
| 7,686,139 | B2 * | 3/2010 | Kondo et al. | 187/391 |
| 7,918,321 | B2 * | 4/2011 | Sakurai | 187/382 |
| 7,921,969 | B2 * | 4/2011 | Stolt et al. | 187/391 |
| 7,931,127 | B2 * | 4/2011 | Kondo et al. | 187/288 |
| 7,938,231 | B2 * | 5/2011 | Ueda et al. | 187/288 |

FOREIGN PATENT DOCUMENTS

| | | |
|---|---|---|
| JP | 54 33454 | 3/1979 |
| JP | 60 148879 | 8/1985 |
| JP | 4 96675 | 3/1992 |
| JP | 6 227771 | 8/1994 |
| JP | 2001 16881 | 1/2001 |
| JP | 2004 231355 | 8/2004 |
| JP | 2005 247512 | 9/2005 |
| JP | 2006 160441 | 6/2006 |

OTHER PUBLICATIONS

U.S. Appl. No. 12/593,087, filed Sep. 25, 2009, Hashimoto, et al.

* cited by examiner

*Primary Examiner* — Anthony Salata
(74) *Attorney, Agent, or Firm* — Oblon, Spivak, McClelland, Maier & Neustadt, L.L.P.

(57) ABSTRACT

In an elevator apparatus, a rescue operation for a car is performed by a rescue operation controller. The rescue operation controller obtains a rescue operation voltage value and applies a voltage having the rescue operation voltage value to a brake coil in response to a signal from a speed detector at a time of the rescue operation for the car. The rescue operation voltage value is a value of the voltage necessary to reduce braking force of a brake device to move the car by using a state of imbalance between the car and a counterweight.

6 Claims, 8 Drawing Sheets

ELEVATOR APPARATUS HAVING RESCUE OPERATION CONTROLLER

TECHNICAL FIELD

The present invention relates to an elevator apparatus capable of performing a rescue operation for a car which is stopped between floors.

BACKGROUND ART

In a conventional rescue operation device in case of failure for an elevator, when a failure occurs in an elevator controller, a brake is released by brake releasing means. As a result, a car is moved due to imbalance between the car and a counterweight. At this time, a travel distance or a speed of the car is detected. Base on results of detection, the brake is operated (for example, see Patent Document 1).

Patent Document 1: JP 2005-247512 A

DISCLOSURE OF THE INVENTION

Problem to be Solved by the Invention

With the conventional rescue operation device in case of failure as described above, however, a sudden acceleration state, a sudden deceleration state, and a stop state are repeated a plurality of times until the arrival of the car at a landing. Therefore, there is fear in that a passenger in the car is made uncomfortable. Moreover, the car is stopped a plurality of times until the arrival at the landing, and hence a time required to complete a rescue operation becomes disadvantageously long.

The present invention is devised to solve the problems described above, and has an object of providing an elevator apparatus capable of performing a rescue operation within a short period of time while preventing ride comfort from being deteriorated.

Means for Solving the Problems

An elevator apparatus according to the present invention includes: a car and a counterweight, each being suspended by a suspending member in a hoistway; a brake device including a brake coil for canceling braking force by excitation thereof, the brake device being for braking the car against a state of imbalance between the car and the counterweight; a speed detector for detecting a speed of the car; and a rescue operation controller for obtaining a rescue operation voltage value corresponding to a value of a voltage necessary to reduce the braking force of the brake device to move the car by using the state of the imbalance between the car and the counterweight and for applying a voltage having the rescue operation voltage value to the brake coil in response to a signal from the speed detector at a time of a rescue operation for the car.

BEST MODES FOR CARRYING OUT THE INVENTION

Hereinafter, preferred embodiments of the present invention are described with reference to the drawings.

First Embodiment

Figure 1:
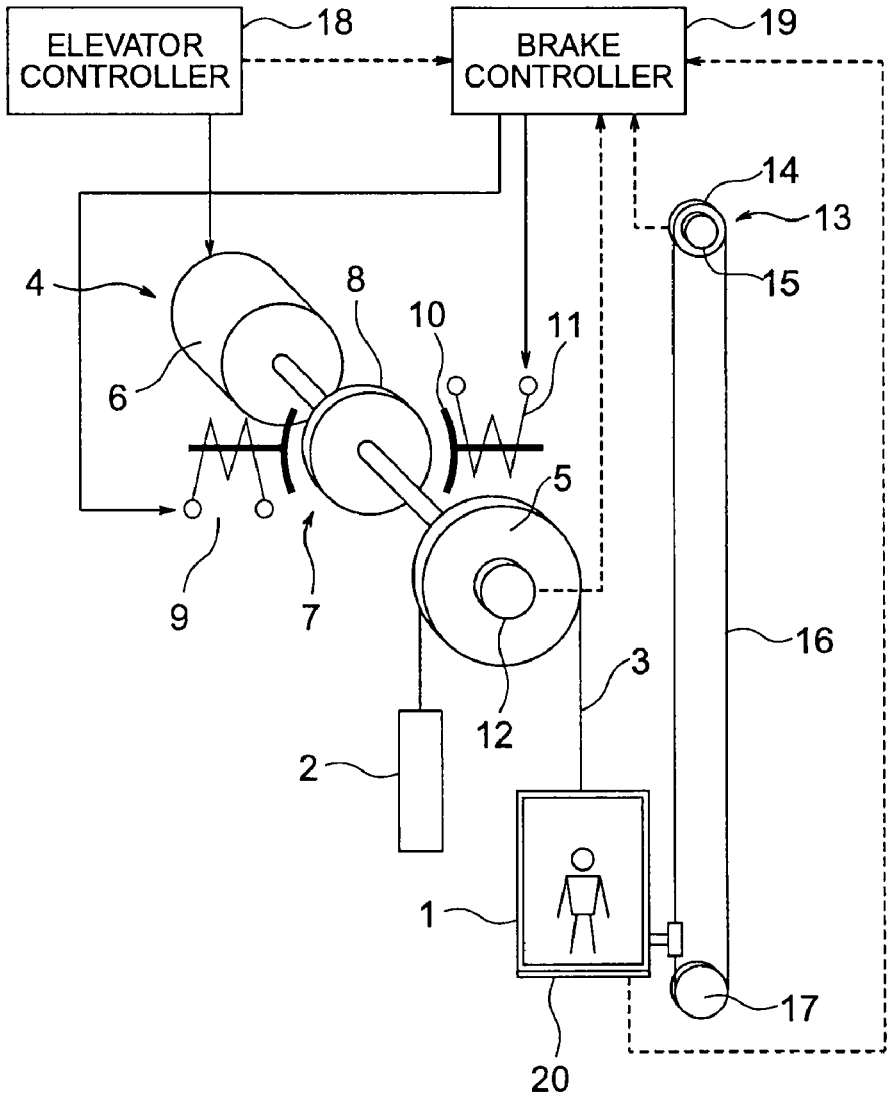
FIG. 1 is a configuration diagram illustrating an elevator apparatus according to a first embodiment of the present invention.

FIG. 1 is a configuration diagram illustrating an elevator apparatus according to a first embodiment of the present invention. In the drawing, a car 1 and a counterweight 2 are suspended by a main rope 3 corresponding to a suspending member in a hoistway and are raised and lowered by a driving force of a hoisting machine 4. The hoisting machine 4 includes a drive sheave 5 around which the main rope 3 is looped, a motor 6 for rotating the drive sheave 5, and braking means 7 for braking the rotation of the drive sheave 5.

The braking means 7 includes a brake wheel 8 which is rotated integrally with the drive sheave 5 and a brake device 9 for braking the rotation of the brake wheel 8. As the brake wheel 8, a brake drum, a brake disc, or the like is used. The drive sheave 5, the motor 6, and the brake wheel 8 are provided on the same shaft.

The brake device 9 includes a plurality of brake linings 10 which are moved into contact with and away from the brake wheel 8, a plurality of brake springs (not shown) for pressing the brake linings 10 against the brake wheel 8, and a plurality of electromagnetic magnets for separating the brake linings 10 away from the brake wheel 8 against the brake springs. Each of the brake magnets includes a brake coil (electromagnetic coil) 11 which is excited by energization.

A current is made to flow through the brake coils 11 to excite the electromagnetic magnets. As a result, an electromagnetic force for canceling the braking force of the brake device 9 is generated to separate the brake linings 10 from the brake wheel 8. On the other hand, by de-energizing the brake coils 11, the electromagnetic magnets are de-excited. By a spring force of the brake springs, the brake linings 10 are pressed against the brake wheel 8.

The brake device 9 brakes the car 1 against a state of imbalance between the car 1 and the counterweight 2. Moreover, the braking force of the brake device 9 is controlled by controlling a voltage applied to the brake coils 11.

A hoisting machine encoder 12 corresponding to a speed detector for generating a signal according to a rotational speed of a rotary shaft of the motor 6, that is, a rotational speed of the drive sheave 5 is provided to the hoisting machine 4. A weighing device 20 for generating a signal according to a load in the car is provided to the car 1.

In an upper part of the hoistway, a speed governor 13 is provided. The speed governor 13 includes a governor sheave 14 and a governor encoder 15 corresponding to a speed detector for generating a signal according to a rotational speed of the governor sheave 14. A governor rope 16 is looped around the governor sheave 14. Both ends of the governor rope 16 are connected to the car 1. A lower end of the governor rope 16 is looped around a tension sheave 17 provided in a lower part of the hoistway.

When the car 1 is raised or lowered, the movement is transmitted through the governor rope 16 to the governor sheave 14 to rotate the governor sheave 14 at a speed according to the speed of the car 1. As a result, the governor encoder 15 generates a signal according to the speed of the car 1.

Drive of the hoisting machine 4 is controlled by the elevator controller 18. Specifically, the ascent and descent of the car 1 is controlled by the elevator controller 18. The brake device 9 is controlled by a brake controller 19. The signals from the elevator controller 18, the weighing device 20, the hoisting machine encoder 12, and the governor encoder 15 are input to the brake controller 19.

When the car 1 is stopped between floors due to some failure, the brake controller 19 executes a rescue operation for the car 1 in response to a rescue operation command from the elevator controller 18. Specifically, the brake controller 19 functions as a rescue operation controller.

Moreover, at the time of the rescue operation for the car 1, the brake controller 19 obtains a rescue operation voltage value corresponding to a value of a voltage to be applied to the brake coils 11 to intermittently apply the obtained voltage to the brake coils 11. The rescue operation voltage value is a value of the voltage required to reduce the braking force of the brake device 9 to move the car 1 by using the state of imbalance between the car 1 and the counterweight 2. In other words, the rescue operation voltage value is a voltage value which is necessary and sufficient (almost minimum) to move the car 1 and is suitable for suppressing vibrations when the car 1 is moved.

Figure 2:
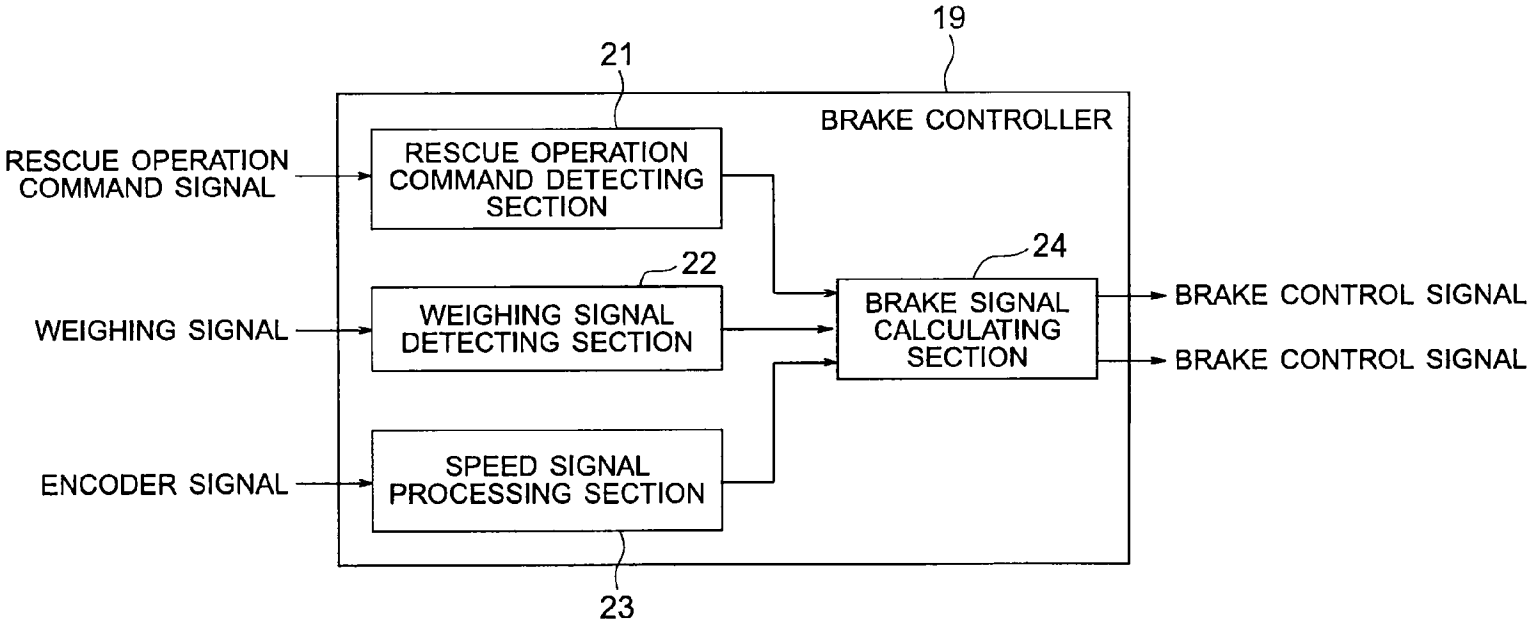
FIG. 2 is a block diagram illustrating a brake controller illustrated in FIG. 1.

FIG. 2 is a block diagram illustrating the brake controller 19 illustrated in FIG. 1. The brake controller 19 includes a rescue operation command detecting section 21, a weighing signal detecting section 22, a speed signal processing section 23, and a brake signal calculating section 24. The rescue operation command detecting section 21 detects a rescue operation command signal from the elevator controller 18. The weighing signal detecting section 22 detects a weighing signal from the weighing device 20. The speed signal processing section 23 calculates the speed of the car 1 based on at least any one of the signal from the hoisting machine encoder 12 and that from the governor encoder 15.

Upon detection of the rescue operation command signal by the rescue operation command detecting section 21, the brake signal calculating section 24 obtains the amount of imbalance between the car 1 and the counterweight 2 based on the weighing signal from the weighing device 20 to calculate the rescue operation voltage value based on the amount of imbalance. A relation between the amount of imbalance and the rescue operation voltage value optimal for the amount of imbalance is pre-registered in the form of an expression or a table in the brake controller 19. Such a relation between the amount of imbalance and the rescue operation voltage value is obtained in advance for each elevator apparatus by calculation or experiment.

Moreover, the brake signal calculating section 24 calculates a target speed of the car 1 at the time of the rescue operation based on the rescue operation command signal. Further, the brake signal calculating section 24 compares the speed of the car 1 obtained by the speed signal processing section 23 and the target speed with each other at the time of the rescue operation. The brake signal calculating section 24 excites the brake coils 11 when the speed of the car 1 is less than the target speed and stops the excitation of the brake coils 11 when the speed of the car 1 is equal to or higher than the target speed. At this time, a value of the voltage for exciting the brake coils 11 is determined as the rescue operation voltage value.

As described above, the brake signal calculating section 24 outputs a brake control signal for turning ON/OFF an excitation voltage to each of the brake coils 11 to allow the speed of the car 1, which is obtained by the speed signal processing section 23, to follow the target speed.

Here, the brake controller 19 includes a computer including a computation processing section (CPU, and the like), a storage section (ROM, RAM, hard disk, and the like), and a signal input/output section. The functions of the brake controller 19 can be realized by computation processing performed by the computer. In the storage section of the computer, programs (software) for realizing the functions are stored. The brake controller 19 may be constituted by an electric circuit for processing analog signals.

Figure 3:
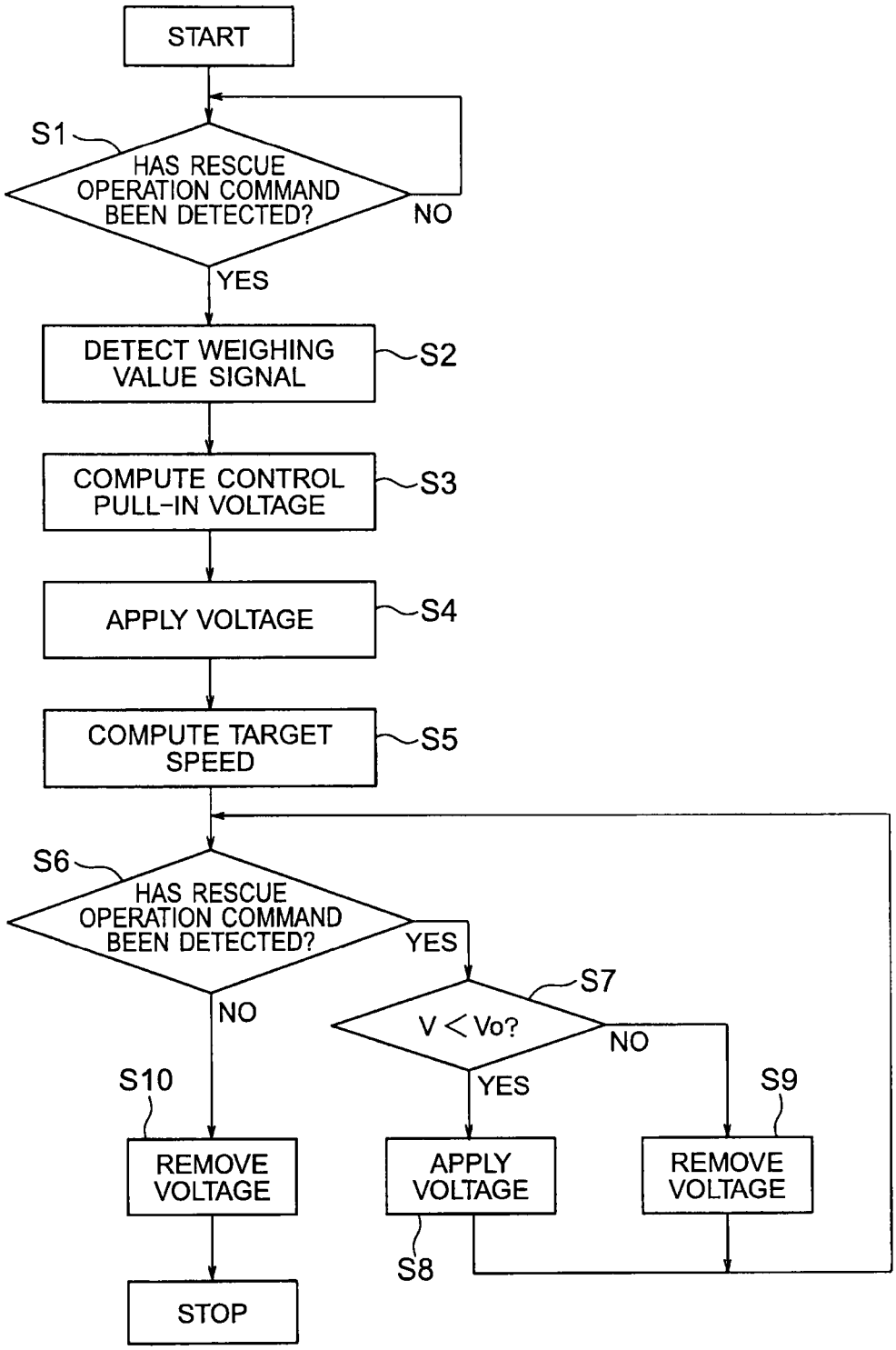
FIG. 3 is a flowchart illustrating an operation of the brake controller illustrated in FIG. 1.
Figure 4:
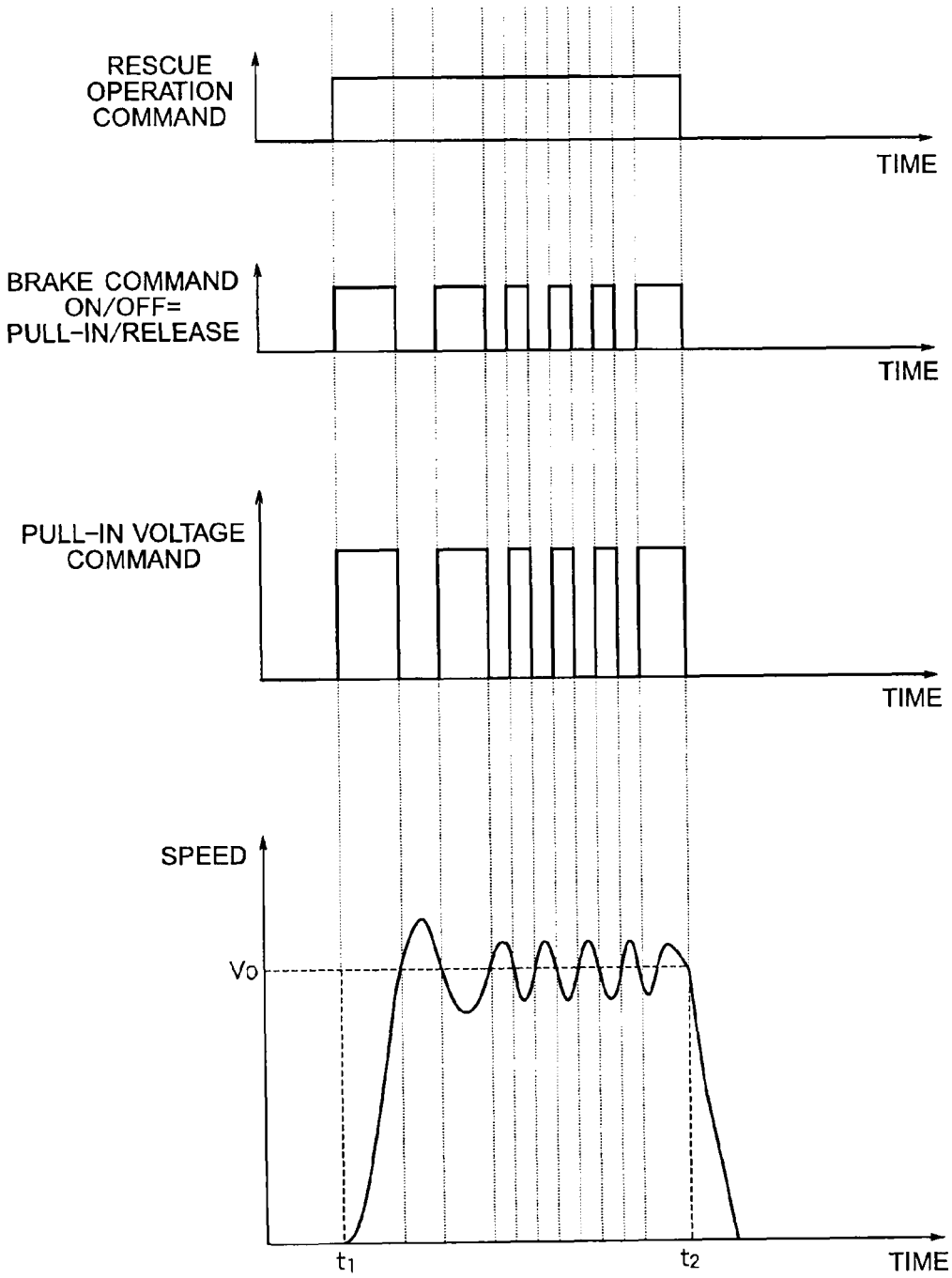
FIG. 4 is a timing chart illustrating a relation between a rescue operation command, a brake command, a pull-in voltage command, and a speed of a car 1 in the elevator apparatus illustrated in FIG. 1.

FIG. 3 is a flowchart illustrating an operation of the brake controller 19 illustrated in FIG. 1. FIG. 4 is a timing chart illustrating a relation between the rescue operation command, the brake command, a pull-in voltage command, and the speed of the car 1 in the elevator apparatus illustrated in FIG. 1. The pull-in voltage command is a command of a value of the voltage to be applied to the brake coils 11.

The brake controller 19 monitors whether or not the rescue operation command has been detected (Step 51). Upon detection of the rescue operation command, the weighing signal is detected to obtain the amount of imbalance between the car 1 and the counterweight 2 (Step S2). Then, based on the amount of imbalance, a computation for obtaining the rescue operation voltage value (control pull-in voltage computation) is executed (Step S3).

When the rescue operation voltage value is determined, the application of the voltage to the brake coils 11 is started (Step S4, at a time t1 in FIG. 4) and a target speed $V_0$ is set (Step S5). After that, it is confirmed whether or not the rescue operation command has been detected (Step S6). If the rescue operation command has been detected, the speed V of the car 1 is compared with the target speed $V_0$ (Step S7). Then, when the speed of the car 1 is less than the target speed, the brake coils 11 are excited (Step S8). When the speed of the car 1 is equal to or higher than the target speed, the excitation of the brake coils 11 is stopped (Step S9).

The operation as described above is repeated. When the car 1 is moved to a landing floor and the rescue operation command is no longer detected, the voltage applied to the brake coils 11 is removed (Step S10, at a time t2 in FIG. 4). The braking force of the brake device 9 is increased to stop the car 1, thereby terminating the rescue operation.

Although a running time of the car 1 is illustrated shorter in FIG. 4 than it actually is for simplicity, the number of times of ON/OFF of the brake command is actually larger than that illustrated in FIG. 4 because one pulse of the brake command is, for example, about 5 msec.

In the elevator apparatus as described above, at the time of the rescue operation for the car 1, the rescue operation voltage value corresponding to the value of the voltage which is necessary to reduce the braking force of the brake device 9 to move the car 1 by using the state of imbalance between the car 1 and the counterweight 2 is obtained. The voltage having the rescue operation voltage value is applied to the brake coils 11 according to the encoder signal. Therefore, the car 1 can be operated at a low speed to follow the target speed without repeating acceleration/deceleration and stop a plurality of times. Accordingly, the rescue operation can be performed within a short period of time while ride comfort is prevented from being deteriorated.

Moreover, at the time of the rescue operation for the car 1, the brake controller 19 obtains the amount of imbalance between the car 1 and the counterweight 2 based on the signal from the weighing device 20. Based on the amount of imbalance, the rescue operation voltage value is obtained. Therefore, the amount of cancellation of the brake, which is necessary to cause the car 1 to run by using the state of imbalance, can be easily estimated. Thus, the rescue operation with vibrations suppressed can be performed without limiting the state of imbalance with which the rescue operation is possible.

Specifically, as the amount of imbalance increases, the rescue operation voltage value is reduced. As a result, if the amount of imbalance is large, the car 1 is not started at a large acceleration rate. Therefore, the rescue operation with vibrations suppressed can be performed.

Further, at the time of the rescue operation for the car 1, the brake controller 19 excites the brake coils 11 when the speed of the car 1 is less than the target speed and stops the excitation of the brake coils 11 when the speed of the car 1 becomes equal to or higher than the target speed. Therefore, the car 1 can be caused to run to follow a safe target speed suitable for the rescue operation.

The weighing device 20 can be provided at any location as long as the signal according to the load in the car can be generated, and therefore, is not limited to that mounted to the car 1.

Second Embodiment

Figure 5:
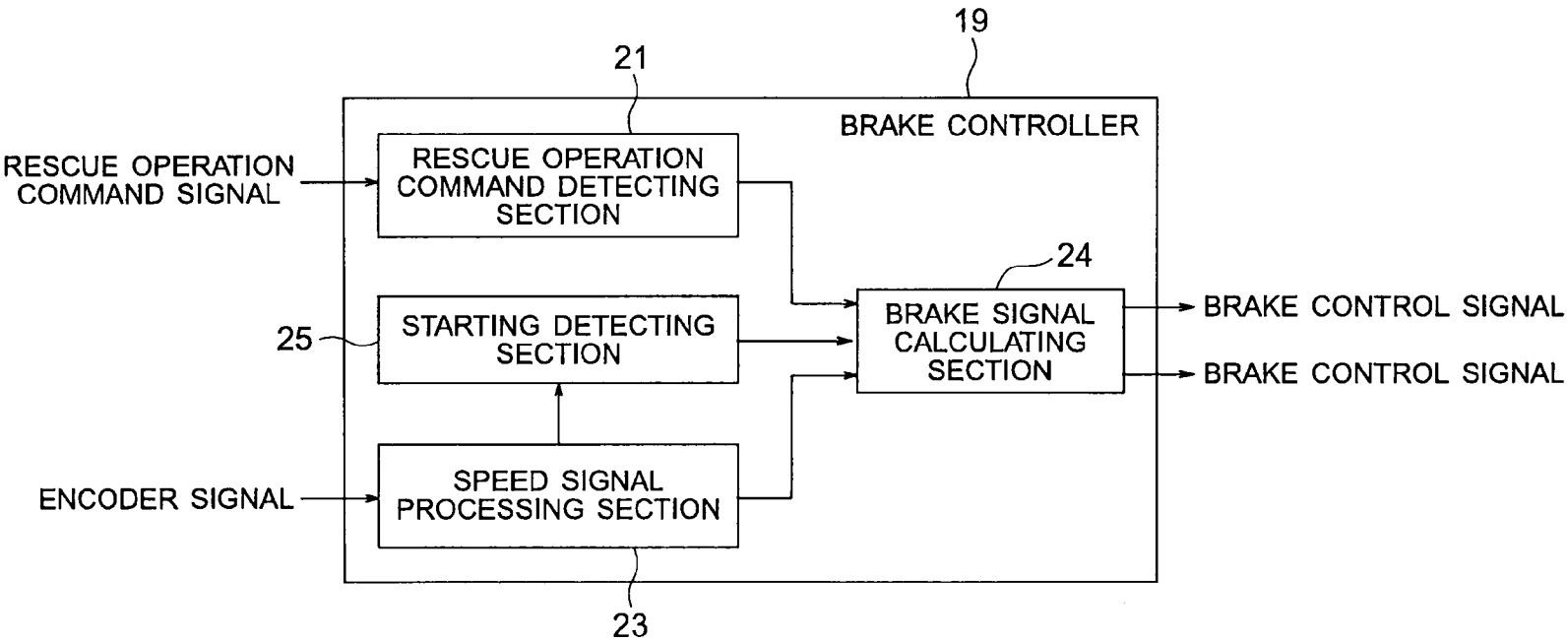
FIG. 5 is a block diagram illustrating a brake controller of an elevator apparatus according to a second embodiment of the present invention.

Next, FIG. 5 is a block diagram illustrating the brake controller 19 for the elevator apparatus according to a second embodiment of the present invention. In the drawing, the brake controller 19 includes the rescue operation command detecting section 21, the speed signal processing section 23, a starting detecting section 25, and the brake signal calculating section 24. The starting detecting section 25 detects starting of the car 1 based on the speed of the car 1, which is obtained by the speed signal processing section 23.

The brake signal calculating section 24 gradually increases the value of the voltage to be applied to the brake coils 11 while monitoring the starting of the car 1 at the time of the rescue operation for the car 1. The value of the voltage when the car 1 is started is used as the rescue operation voltage value. The remaining configuration is the same as that of the first embodiment.

Figure 6:
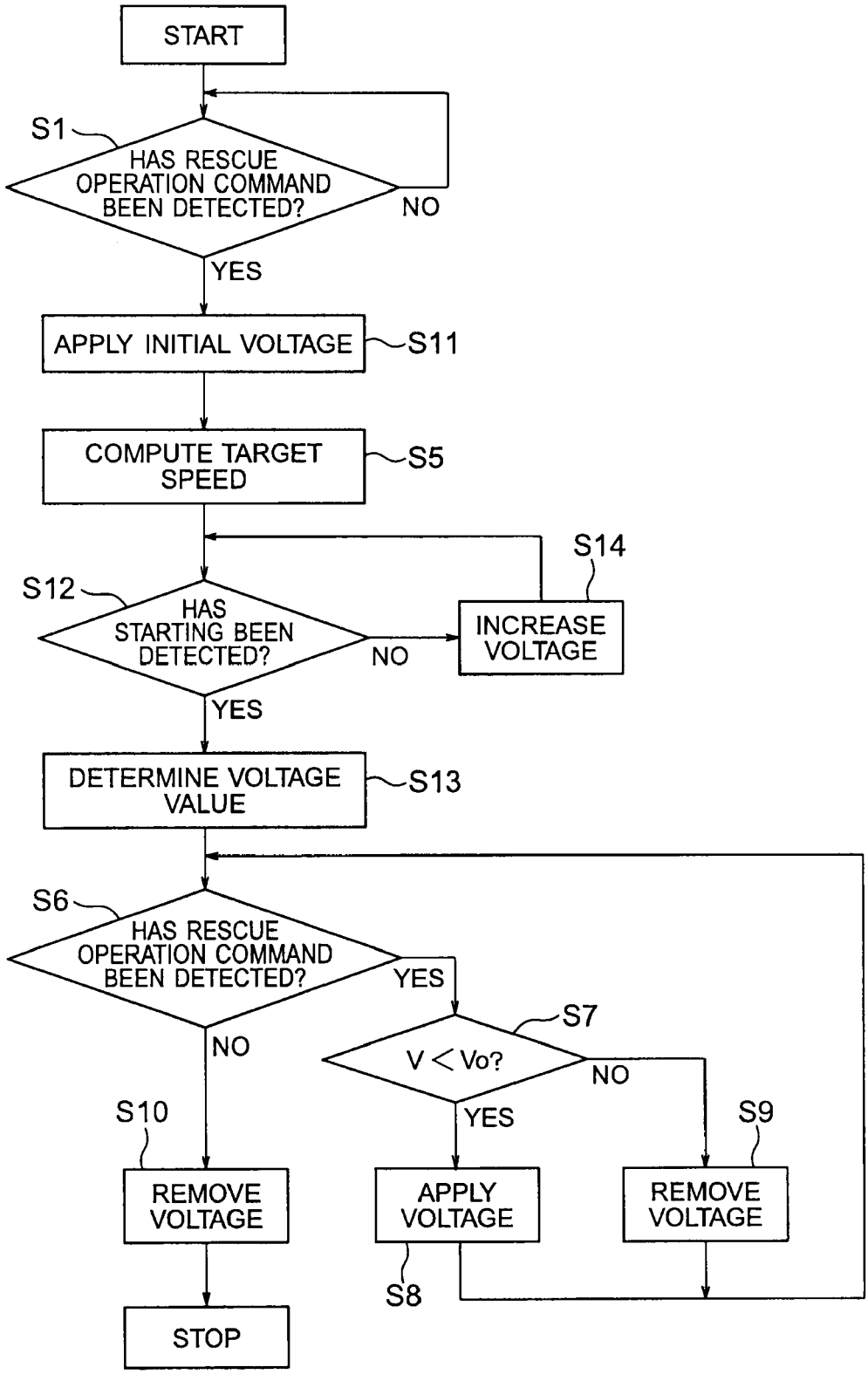
FIG. 6 is a flowchart illustrating an operation of the brake controller illustrated in FIG. 5.
Figure 7:
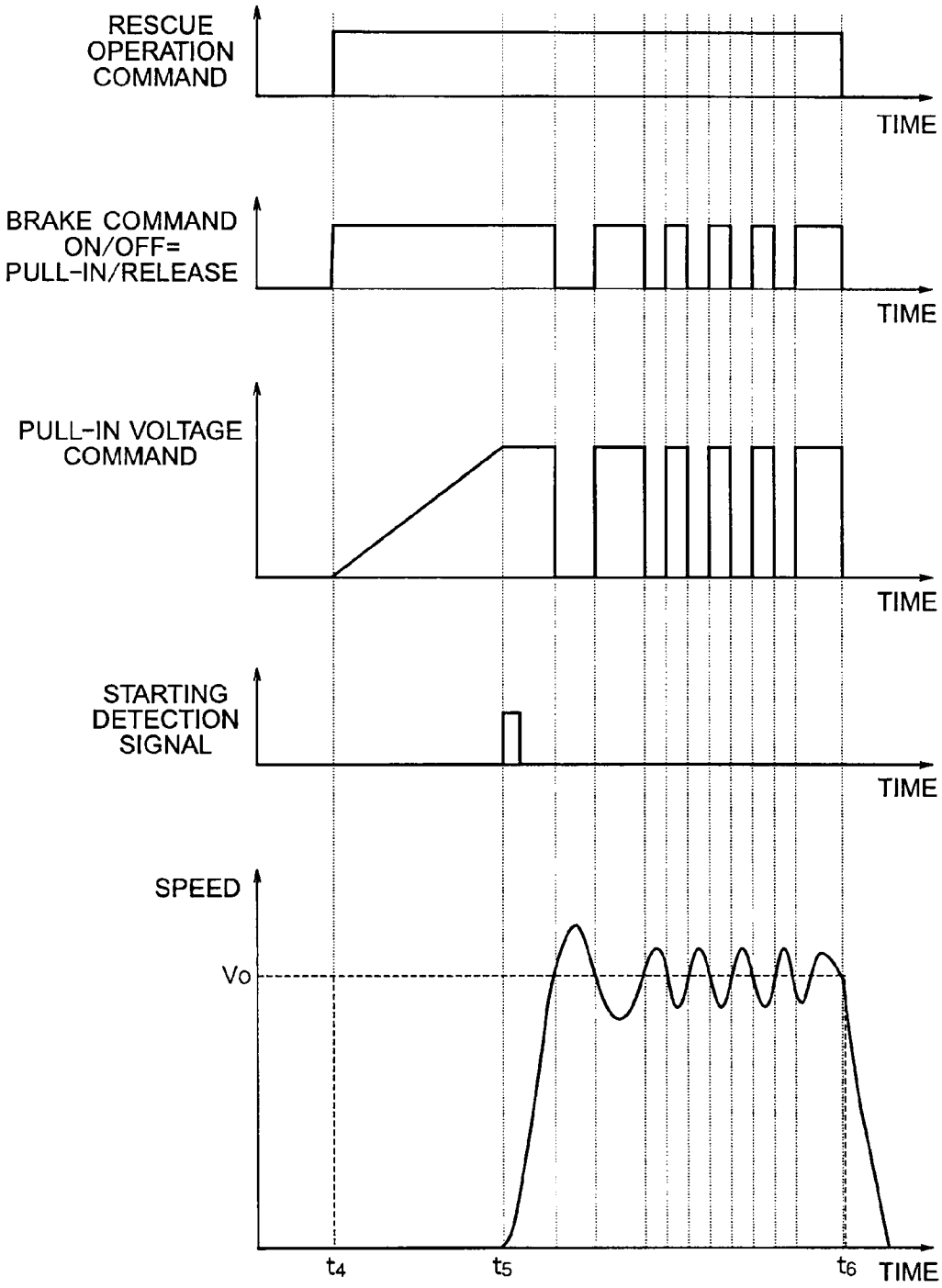
FIG. 7 is a timing chart illustrating a relation between a rescue operation command, a brake command, a pull-in voltage command, and a speed of a car 1 in the elevator apparatus according to the second embodiment.

FIG. 6 is a flowchart illustrating the operation of the brake controller 19 illustrated in FIG. 5. FIG. 7 is a timing chart illustrating the relation between the rescue operation command, the brake command, the pull-in voltage command, and the speed of the car 1 in the elevator apparatus according to the second embodiment.

The brake controller 19 monitors whether or not the rescue operation command has been detected (Step S1). Upon detection of the rescue operation command, an initial voltage is applied to the brake coils 11 (Step S11, at a time t4 in FIG. 7) and the target speed $V_0$ is set (Step S5). Then, it is confirmed whether or not the starting of the car 1 has been detected (Step S12). A value of the initial voltage is set to a value small enough to prevent the car 1 from being started even when the amount of imbalance between the car 1 and the counterweight 2 is the largest.

The brake controller 19 gradually increases the voltage applied to the brake coils 11 until the car 1 is started (Step S14). Then, when the starting of the car 1 is detected (at a time t5 in FIG. 7), a voltage value at that time is set as the rescue operation voltage value (Step S13).

Upon determination of the rescue operation voltage value, it is confirmed whether or not the rescue operation command has been detected (Step S6). If the rescue operation command has been detected, the speed V of the car 1 is compared with the target speed $V_0$ (Step S7). If the speed of the car 1 is less than the target speed, the brake coils 11 are excited (Step S8). If the speed of the car 1 is equal to or higher than the target speed, the excitation of the brake coils 11 is stopped (Step S9).

The operation as described above is repeated. When the car 1 is moved to a landing floor and the rescue operation command is no longer detected, the voltage applied to the brake coils 11 is removed (Step S10, at a time t6 in FIG. 4). The braking force of the brake device 9 is increased to stop the car 1, thereby terminating the rescue operation.

In the elevator apparatus as described above, the rescue operation voltage value can be determined without using the weighing device 20. Thus, the rescue operation with vibrations suppressed can be performed without limiting the state of imbalance with which the rescue operation is possible.

Third Embodiment

Figure 8:
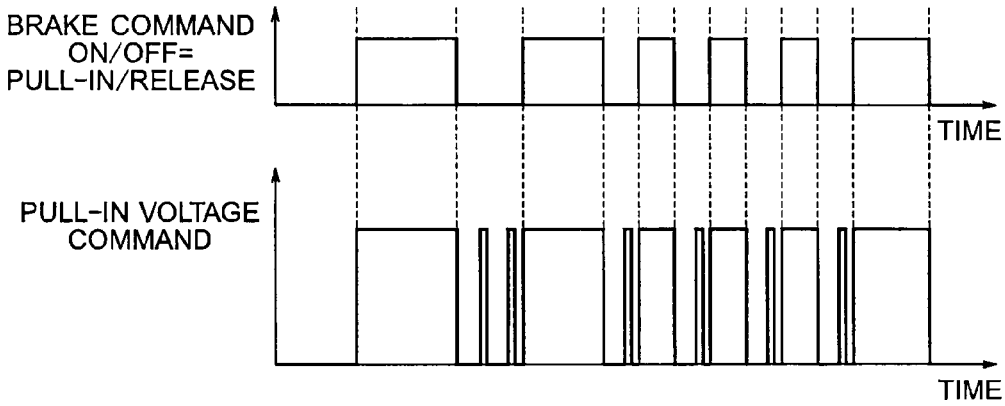
FIG. 8 is a timing chart illustrating a relation between a brake command and a pull-in voltage command at the time of a rescue operation in an elevator apparatus according to a third embodiment of the present invention.

Next, FIG. 8 is a timing chart illustrating the relation between the brake command and the pull-in voltage command at the time of rescue operation in the elevator apparatus according to a third embodiment of the present invention. The brake controller 19 excites the brake coils 11 when the speed of the car 1 is less than the target speed at the time of the rescue operation for the car 1 and reduces a time ratio for exciting the brake coils 11 when the speed of the car 1 becomes equal to or higher than the target speed.

More specifically, the brake controller 19 applies the voltage to the brake coils 11 with a predetermined cycle within a time period in which the speed of the car 1 is higher than the target speed and the brake command is OFF. An application time and a cycle of application of the voltage in the time period in which the brake command is OFF are set sufficiently shorter than an average length of the time period in which the brake command is OFF. The remaining structure is the same as that of the first or second embodiment.

In the elevator apparatus as described above, a reduction of the current flowing through the brake coils 11 is delayed in the time period in which the brake command is OFF. Therefore, a sudden increase of a brake torque can be prevented to further suppress the vibrations at the time of the rescue operation.

Fourth Embodiment

Figure 9:
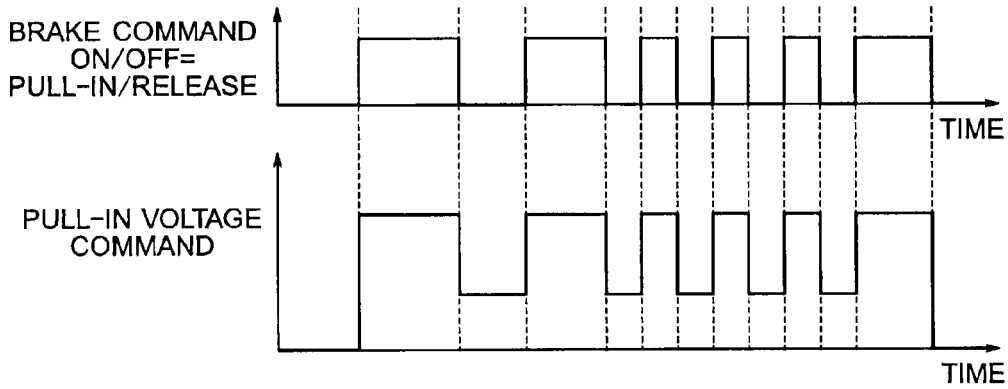
FIG. 9 is a timing chart illustrating a relation between a brake command and a pull-in voltage command at the time of a rescue operation in an elevator apparatus according to a fourth embodiment of the present invention.

Next, FIG. 9 is a timing chart illustrating the relation between the brake command and the pull-in voltage command at the time of rescue operation in the elevator apparatus according to a fourth embodiment of the present invention. The brake controller 19 excites the brake coils 11 when the speed of the car 1 is less than the target speed at the time of the rescue operation for the car 1 and sets the voltage, at which the brake coils 11 are excited, not to zero but to a predetermined voltage value lower than the rescue operation voltage value when the speed of the car 1 becomes equal to or higher than the target speed.

In this example, when the speed of the car 1 becomes higher than the target speed, the brake controller 19 sets the voltage, at which the brake coils 11 are excited, to less than 50% and equal to or larger than 20% of the rescue operation voltage value. The remaining structure is the same as that of the first or second embodiment.

In the elevator apparatus as described above, a reduction of the current flowing through the brake coils 11 is delayed in the time period in which the brake command is OFF. Therefore, a sudden increase of a brake torque can be prevented to further suppress the vibrations at the time of the rescue operation.

Although the brake device 9 including two sets of the brake linings 10 and the brake coils 11 is described in the above-mentioned example, the number of sets of the brake linings 10 and the brake coils 11 may be one or equal to or larger than three.

Moreover, although the brake device 9 is provided to the hoisting machine 4 in the above-mentioned example, the brake device 9 is not limited thereto. For example, the brake device 9 may be, for example, a car brake mounted to the car 1, a rope brake for gripping the main rope 3, or the like.

Further, although the brake controller 19 also serves as the rescue operation controller in the above-mentioned example, the rescue operation controller may be provided independently of the brake controller 19 for controlling the brake device 9 at the time of a normal operation.

The invention claimed is:

1. An elevator apparatus, comprising:

a car and a counterweight, each being suspended by a suspending member in a hoistway;

a brake device including a brake coil for canceling braking force by excitation thereof, the brake device being for braking the car against a state of imbalance between the car and the counterweight;

a speed detector for detecting a speed of the car; and a rescue operation controller to determine that a rescue operation has been determined, wherein the rescue operation controller further determines an amount of imbalance between the car and the counterweight, to obtain a rescue operation voltage value corresponding to a value of a voltage necessary to reduce the braking force of the brake device to move the car by using the determined amount of the imbalance between the car and the counterweight and wherein the rescue operation controller applies a voltage having the rescue operation voltage value to the brake coil in response to a signal from the speed detector at a time of a rescue operation for the car.

2. An elevator apparatus according to claim 1, further comprising a weighing device for detecting a load in the car, wherein the rescue operation controller determines the amount of the imbalance between the car and the counterweight based on a signal from the weighing device to obtain the rescue operation voltage value based on the amount of the imbalance at the time of the rescue operation for the car.

3. An elevator apparatus comprising:

a car and a counterweight, each being suspended by a suspending member in a hoistway;

a brake device including a brake coil for canceling braking force by excitation thereof, the brake device being for braking the car against a state of imbalance between the car and the counterweight;

a speed detector for detecting a speed of the car; and a rescue operation controller for obtaining a rescue operation voltage value corresponding to a value of a voltage necessary to reduce the braking force of the brake device to move the car by using an amount of the imbalance between the car and the counterweight and for applying a voltage having the rescue operation voltage value to the brake coil in response to a signal from the speed detector at a time of a rescue operation for the car, wherein the rescue operation controller gradually increases the value of the voltage applied to the brake coil and monitors starting of the car to set the value of the voltage at which the car is started as the rescue operation voltage value at the time of the rescue operation for the car.

4. An elevator apparatus according to claim 1, wherein the rescue operation controller excites the brake coil when the speed of the car is less than a target speed and stops excitation of the brake coil when the speed of the car becomes equal to or higher than the target speed at the time of the rescue operation for the car.

5. An elevator apparatus according to claim 1, wherein the rescue operation controller excites the brake coil when the speed of the car is less than a target speed and reduces a time ratio for exciting the brake coil when the speed of the car becomes equal to or higher than the target speed at the time of the rescue operation for the car.

6. An elevator apparatus according to claim 1, wherein the rescue operation controller excites the brake coil when the speed of the car is less than a target speed and sets the voltage, at which the brake coil is excited, lower than the rescue operation voltage value when the speed of the car becomes equal to or higher than the target speed at the time of the rescue operation for the car.

* * * * *